US007708863B2

(12) United States Patent
Petroski et al.

(10) Patent No.: US 7,708,863 B2
(45) Date of Patent: May 4, 2010

(54) PROCESS FOR MOLDING A FRICTION WAFER

(75) Inventors: Angela L. Petroski, Crawfordsville, IN (US); Samuel A. Truncone, Crawfordsville, IN (US); James Macey, Arcadia, MI (US); Hualin Jiang, Granger, IN (US)

(73) Assignee: Raytech Composites, Inc., Crawfordsville, IN (US)

( * ) Notice: Subject to any disclaimer, the term of this patent is extended or adjusted under 35 U.S.C. 154(b) by 589 days.

(21) Appl. No.: 11/509,268

(22) Filed: Aug. 24, 2006

(65) Prior Publication Data

US 2009/0025898 A1 Jan. 29, 2009

Related U.S. Application Data

(60) Provisional application No. 60/710,918, filed on Aug. 24, 2005.

(51) Int. Cl.
*D21F 13/00* (2006.01)

(52) U.S. Cl. ..... 162/218; 162/219; 162/224; 162/227; 428/34.2

(58) Field of Classification Search ..... 162/218, 162/219, 224, 227; 438/691; 451/397; 264/86, 264/87; 428/34.2
See application file for complete search history.

(56) References Cited

U.S. PATENT DOCUMENTS

| | | | | |
|---|---|---|---|---|
| 3,864,206 | A | 2/1975 | Linderoth | |
| 3,990,940 | A | 11/1976 | Lee et al. | |
| 4,279,696 | A | 7/1981 | Piersol | |
| 4,656,203 | A | 4/1987 | Parker | |
| 5,453,317 | A | 9/1995 | Yesnik | |
| 5,529,666 | A | 6/1996 | Yesnik | |
| 5,573,579 | A | 11/1996 | Nakanishi et al. | |
| 5,639,804 | A | 6/1997 | Yesnik | |
| 5,744,075 | A | 4/1998 | Klett et al. | |
| 5,871,838 | A | 2/1999 | Klett et al. | |
| 6,331,358 | B1 | 12/2001 | Kitahara et al. | |
| 6,899,610 | B2 * | 5/2005 | Cooper et al. | 451/397 |
| 7,008,509 | B1 | 3/2006 | Otani et al. | |
| 2002/0127862 | A1 * | 9/2002 | Cooper et al. | 438/691 |
| 2003/0147804 | A1 | 8/2003 | Ogawa et al. | |
| 2004/0028768 | A1 | 2/2004 | Seimetz | |
| 2005/0248067 | A1 | 11/2005 | Geiger | |

FOREIGN PATENT DOCUMENTS

| | | | |
|---|---|---|---|
| EP | 000386652 | A1 | 9/1990 |
| EP | 0640774 | A1 | 3/1995 |
| EP | 1359339 | A2 | 11/2003 |
| JP | 357054745 | A | 4/1982 |
| JP | 359140929 | A | 8/1984 |
| JP | 363289026 | A | 11/1988 |
| WO | PCT/US2008/11571 | | 10/2008 |

* cited by examiner

*Primary Examiner*—Mark Halpern
(74) *Attorney, Agent, or Firm*—Krieg DeVault LLP

(57) ABSTRACT

A process and apparatus for making die-dried friction wafers collects friction particulates in a mold defining a wafer. The mold includes at least one perforate wall portion against which an aqueous slurry including the particulates is passed to form at least one layer on the wall as the particulates collect in the mold. The collection is dried followed by curing, and may be cured in the mold by heating.

15 Claims, 3 Drawing Sheets

PROCESS FOR MOLDING A FRICTION WAFER

CROSS-REFERENCE TO RELATED APPLICATIONS

This application claims the benefit of U.S. provisional application Ser. No. 60/710,918 filed Aug. 24, 2005.

BACKGROUND OF THE INVENTION

1. Field of the Invention

The present invention relates to a die-dried friction wafer and to a method for making a friction plate by net-shape molding a friction wafer of fiber, fillers, and resin binder in a configured mold cavity, and bonding to a steel core.

2. Background Art

The traditional processes for manufacturing friction plates involve forming a specialized paper, a laborious wet-laid sheet forming process, then impregnating the paper with a thermoset resin(s), driving off the solvent, curing the treated paper, and applying the impregnated paper to cores, generally in the form of steel plates. The process usually involves cutting annular rings or segments from the paper sheets or the treated paper sheets. Although the paper rings can easily be cut from the sheets, much paper can be wasted from the area inside and outside the rings. Moreover, when the cutting is performed on the resin impregnated papers, the offal may not be recyclable for re-manufacturing or reclaimed for other uses.

In a conventional wet laid process, a slurry of fibers, fillers and binders is laid or drawn onto a wire mesh conveyor while the water is being removed through the wire. The wire mesh conveyor is transferred over water removing stations. This process is typically performed on a standard paper machine. The resultant porous friction paper, which does not contain a resin, is then impregnated with a resin in a subsequent processing step, dried, cured, blanked, and bonded to a steel core to make the friction assembly. The paper can be blanked into annular rings or segments prior to or after the resin impregnation process. The bonding and curing operation can also occur in one step.

The use of a so called "beater add" process for making friction materials for liquid cooled and dry friction applications involves mixing a slurry of fibers, fillers, binders, friction particles, 'beater-add' resin(s), processing aids and friction enhancing media in a water slurry and then removing the water using suction and drying, typically performed on a paper machine. The term "beater-add" refers to the type of resin that is added in powder form to the aqueous slurry. The resin must be compatible with water. The component(s) of the resin that cause it to cure with heat must also not dissolve in the water allowing the resin to maintain it's cross-linking or curing capability after it has been dispersed in water. The advantage of beater-add is the elimination of the saturation of the paper with resin associated with the conventional wet laid friction material manufacturing process.

In the beater add process, the resin is included in the slurry. While elimination of the saturation process step is an advantage compared to the conventional process of wet-laid material saturation, it is still not a widely used process for the production of friction assemblies due to the long standing issues of manufacturing paper sheets, and the associated laborious and wasteful blanking of rings or segments from these sheets with the beater add process.

One issue is the need to dry out the beater add material sufficiently so that it may be blanked, cured and bonded to the steel core. This dry out is generally done in the dryer section of the paper machine. If the material temperature becomes too high, the cure will be prematurely advanced, having a negative impact on product performance. A major issue is the heat retained in the material as it is rolled at the end of the paper machine. This heat can begin to cure the resin and create an exothermic reaction in the roll, often resulting in a fire hazard or a roll of unusable material. The beater-add material is therefore generally not suitable for rolling onto reels or rolls as is done for the conventional wet-laid process prior to saturation.

Hence, the process for beater add materials is generally associated with cutting large sheets or pads as opposed to rolls, and subsequently blanking the annular rings or segments from these sheets. The use of sheets rather than rolls is a serious limitation on the cost effective production of friction assemblies because sheeting requires a separate machine. In addition, the offal after blanking the ring is considered hazardous waste unless the resin is first fully cured, therefore there is added expense to fully cure and/or dispose of the offal properly.

Additionally, the carry over of constituents from the beater add formulation into the water used for the slurry often limits the use of a wet-laid machine with a closed loop water system for the production of both non-resin and beater add materials on a single machine. Due to the resin in the formulation, the large amounts of process water used in paper making must generally be filtered and treated before re-use or discharge; adding to the cost of the beater-add process.

SUMMARY OF THE INVENTION

The present invention overcomes the above disadvantages by providing a method of producing friction wafers in a cost-effective manner using an aqueous slurry with friction particulates. The particulates may include combinations of fibers, fillers, binders, friction particles, beater-add resin(s) and other friction enhancing media. The wafer is "die-dried" as the formation of the wafer results from collecting the slurry in a net shape mold or die with a perforated screen and removing the water from the collection.

Preferably, removal first occurs by vacuum and gravity drainage through this screen or wire. The wet die molded wafer may then be further dried in the mold, or preferably, transferred to a drying station and dried via a heated platen and air flow to segregate the time delay of curing from the accumulation process when more time may be required for curing each wafer. The invention may introduce some key modifications to tooling, equipment, processes, and formulations for manufacturing friction materials, as well as modifications to a die-dried method formerly used for manufacturing speaker cones. For example, processes like that used by Harmon International Industries, Inc. previously located in Prairie du Chien, Wis. may be adapted by the invention to provide a unique method of manufacturing die-dried friction wafers. The result is a unique method of manufacturing beater-add friction wafers and unique production of friction assemblies.

The new process preferably involves adding a beater add slurry to the a molding apparatus adapted to define a net shape mold wall. As used in the disclosure, net shape refers to the shapes of friction bodies, for example annular rings or cylindrical sleeves, that papers conform with after sheets have been cut, to attach to and conform with friction layer substrates. The term does not require finished dimension wafer size as the wafer may be trimmed or not without departing from the present invention. Although this process can manufacture shaped friction wafers without resin already in them, the preferred embodiment of the method for this process is the use of a beater-add resin in the slurry. Preferably, the slurry is collected in a mold that is, preferably at least nominally, a wall having the inner and outer diameter dimensions of the wafer to be bonded to the steel core. The slurry is collected in the mold and the water in the slurry is removed through a molding wire, or perforated screen, that is at least one wall of the mold. Using this process may avoid sheets, pads, rolls or reels of material produced or processed. Only the net shape wafers are created during the collection and curing process steps. Preferably, after collecting the slurry in the mold, the wafer is at least partially dried by removing water through the wire side of the wafer mold, or "die". Then the wafer is heated to a specified temperature depending upon the constituents for additional drying and for curing of the resin. The cured or partially cured wafer may then be bonded to the core. Subsequent sizing or machining may only be necessary if the rings must be sized differently than what the mold or die produces, or if unique slots, holes, or grooves are desired.

The invention may eliminate many issues associated with the beater add sheets or pads since curing, or partial curing of the wafer either in the mold, or at a subsequent pressing and drying station is acceptable and may even be desirable for subsequent wafer handling issues, and to prevent dangerous exothermic reactions that can occur in rolls or stacked sheets. In addition, the molding of a wafer eliminates the offal often generated by the blanking of wafers from pads or sheets, and may only require secondary blanking to achieve proper wafer dimensions.

Thus, the process may produce product without numerous operations and apparatus previously required, including eliminating one or more conventional paper making, blanking, trim handling, saturating, oven curing, bore and turning to bring in dimensions such as ID, OD, or both to tolerance, and grinding steps previously required.

BRIEF DESCRIPTION OF THE DRAWINGS

The present invention will be more clearly understood by reference to the following detailed description of the preferred embodiment when read in conjunction with the accompanying drawing in which like reference characters refer to like parts throughout the views and in which.

DETAILED DESCRIPTION OF THE PREFERRED EMBODIMENT(S)

Figure 1:
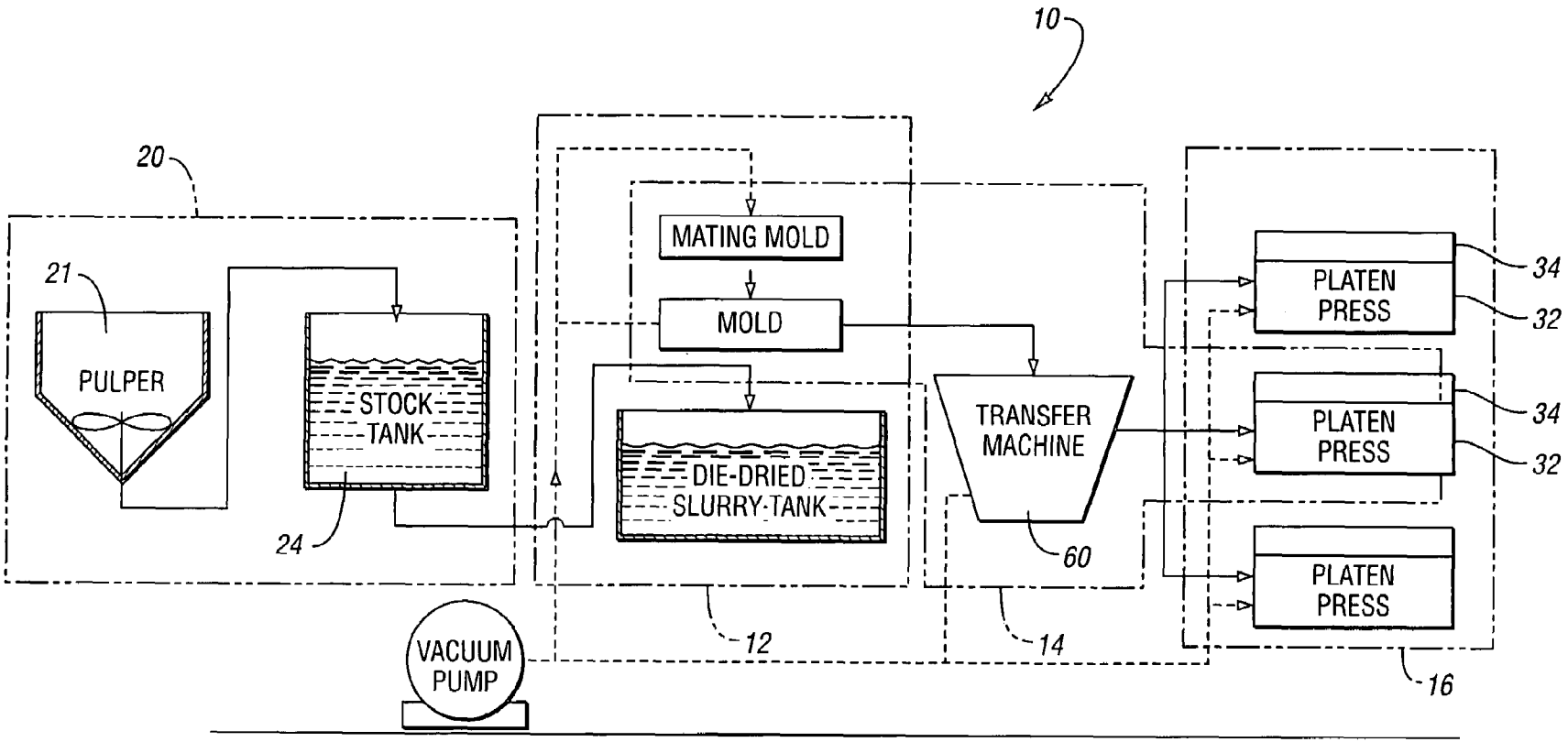
FIG. 1 is a process flow diagram of a process forming die-dried friction wafers according to the present invention.

Referring first to FIG. 1, a process 10 according to the present invention includes a forming step 12, a drying step 14 and a curing step 16. As indicated by the diagrammatic outlines in FIG. 1, each of the steps are not mutually exclusive and may occur at a workstation in which one or more of the steps may be performed, and the steps are not limited to only one of the stations in a production process. The formed or molded wafers are formed by accumulating friction material, referred to as wet friction material when used as part of mechanisms performing within a lubrication (wet) supply, from an aqueous slurry with particulates including fillers, friction fibers, binders and friction resins. Curing of the resins is often performed at high temperatures, and thus requires drying of the accumulated materials from the slurry so as to control the curing of the resins in a practical manner.

The process may incorporate previously known friction paper processing manufacturing apparatus including a pulper, in which the constituents are combined, and a stock tank in which the friction material constituents are dispersed in a aqueous solution. In any event, the supply 20 introduces aqueous slurry with friction material resins, fillers, fibers and resins with communication media which can be introduced to a mold.

The molding step 12 provides flexibility in the type of operation and equipment to be used. In the preferred embodiment, technology previously referred to as die-dried molding that was employed in the formation of speaker cones may be used. However, so long as the mold 30 including the mold chamber 26 and a perforated wall 24 receives the slurry and permits water removal, several ways of introducing slurry to the mold chamber are described. A displaceable mold in a slurry tank 40 and other filling processes will be discussed in greater detail with respect to FIGS. 2 through 4. Forming operation 12 includes movement of the aqueous slurry through the mold cavity 26 so that the solution passes through the perforated mold wall 24 and so that the friction fibers, fillers, resins and other particulates may collect on the perforated wall 24. After a predetermined time with a predetermined flow rate and predetermined concentration of slurry, or after a predetermined accumulation of material on a mold wall 24, any accumulated material 25 must be cured by heating the resin with the application of heat. While drying and curing apparatus can be incorporated on the molding apparatus as suggested throughout the description, the drying and/or curing may occur at a mating mold chamber that receives the accumulation 25 before drying or curing or preferably at a hot platen station.

The drying step 14 may be accomplished at least in part in the forming step 12, although as discussed above it may be performed as part of a transfer mechanism or the curing station 31 equipment as desired. Nevertheless, the removal of water permits the accumulation 25 to be treated by heating without uncontrolled vapor release when drying precedes the curing steps 16. Moreover, while the curing step 16 may provide one or more platen presses 32 having molds 34 which can be heated to cure the resin and thus dimensionally fix the accumulation 25 as a fixed size wafer, the die-dried friction wafer curing process is preferably separate from the forming station 12. Moreover, a single mold of step 12 may produce accumulations that are delivered to a plurality of platen presses 32 so that the long time for curing may be accommodated when accumulation 25 may be made at a faster rate of molding. The number of molds in each molding step 12, the transfer machines during the drying step 14 and the number of platen presses in the curing step 16 may be varied as desired in order to accommodate an efficient production facility.

Figure 2:
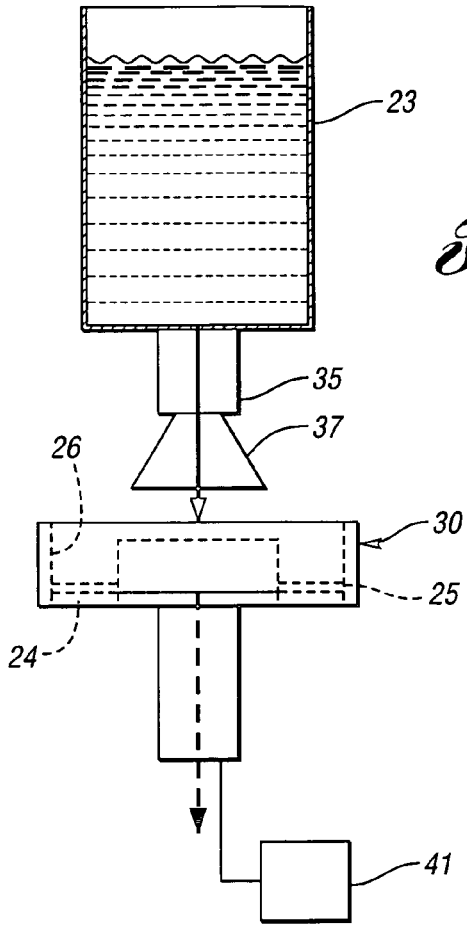
FIG. 2 is a diagrammatic view of a 'mold-fill' method included in a process shown in FIG. 1.
Figure 3:
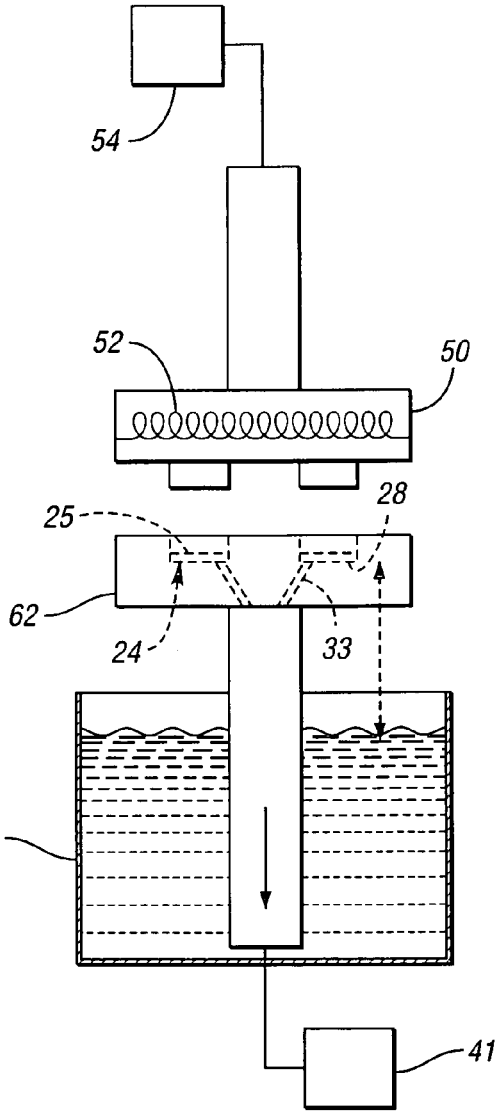
FIG. 3 is a diagrammatic view of a 'bottom forming' method included in a process shown in FIG. 1.
Figure 4:
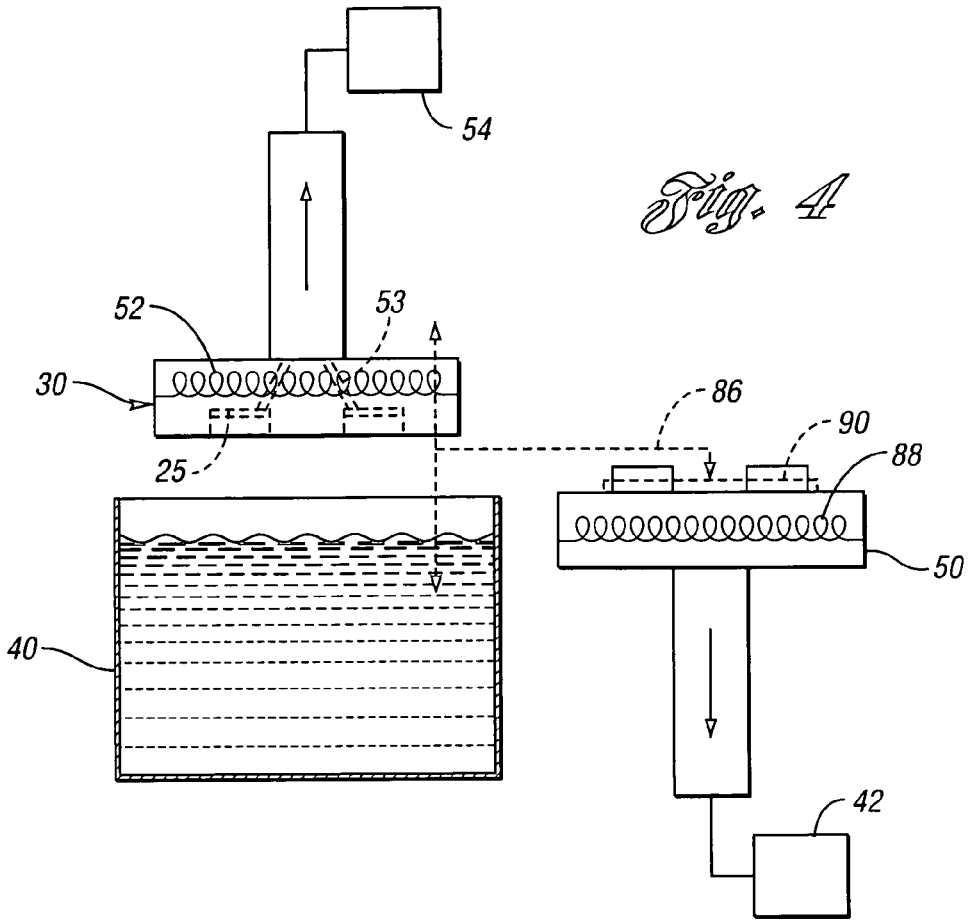
FIG. 4 is a diagrammatic view of a "top forming' method included in a process shown in FIG. 1, and also showing a wafer as formed in the FIG. 1 engaged for curing on a core.

During the forming step 12, several mold fill methods are disclosed in FIGS. 2 through 4. In FIG. 2, the slurry tank 23 may be a separate stock tank 22, although strict separation is not required. The slurry tank communicates to the mold cavity 26 in the mold 30 through a flow meter 35 which gages the amount of aqueous slurry at a predetermined concentration of fibers, friction fillers, binders and resins is delivered at a predetermined rate. Timers or sensors may gauge when a sufficient accumulation of particulates occurs on the perforated mold wall 24. In addition, the flow passages may include a distributor 37 that as diagrammatically shown in FIG. 2, may be a conical surface that ends at a size about the mean radius of the cavity 26 that distributes the aqueous slurry into the mold cavity 26. A vacuum source 41 may be limited to water removal only so that the accumulation 25 may be removed from the mold 30, or heated in the mold if the mold is so equipped for drying and/or curing.

As shown in FIG. 3, the accumulation 25 may be formed by displacing the mold 30 within the slurry tank 40. A vacuum 42 may be coupled to the tank for fluid communication with mold passages 33 and enable the mold cavity 26 to communicate with the vacuum 41 for drying of the wafer. In addition, a mating and transfer mold 52 conforms with the shape of the mold 62 and includes a vacuum source 54 that enables the accumulation 25 in the mold to be released from the mold 30 and transferred to a different station. The vacuum source 54 also supplements drying of the material as it passes to a curing station.

Referring to FIG. 4, a forming mold may be a top forming mold in which the perforated wall 24 is coupled by passages 53 through a vacuum source 54 which performs a lift and water removal operation on the accumulation 25 at the perforated mold wall 24. The mold 30 may be then transferred or displaced as diagrammatically shown at 86 to another slurry tank for layering material or to a station in which a mating mold part 50 including a heating element 88 may be activated to and/or cure the accumulation released from the mold 30 when the vacuum source 84 is disconnected. A supplemental vacuum source 42 may then be applied to the mating mold 50 to complete drying and/or curing of the wafer. Moreover, a mating mold may be provided with a core 90 so that the transfer of the accumulation 25 to the mating mold 50 for curing may also be used to bond the wafer to the core 90.

Figure 6:
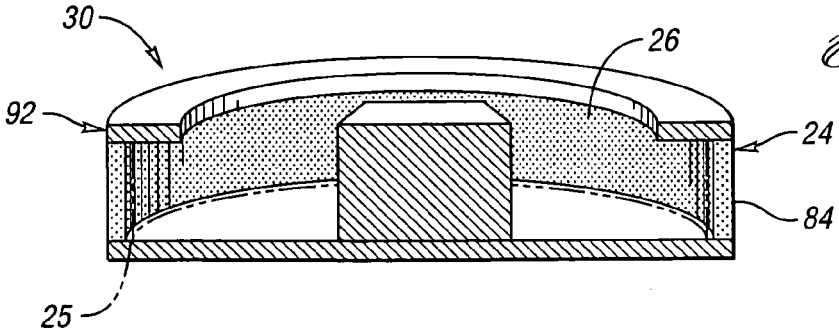
FIG. 6 is a broken perspective view of a mold for making cylindrical friction wafers according to the present invention.

As shown in FIG. 6, it is to be understood that a perforated wall 24 of the mold 30 need not be an annular wall. In particular, FIG. 6 shows a mold in which the cavity 26 is confined by a cylindrical perforated wall 84. In such a mold 92, the accumulation 25 occurs adjacent the cylindrical wall 84 to form a cylindrical wafer, for example, a synchronizer ring or band of friction material.

Figure 5:
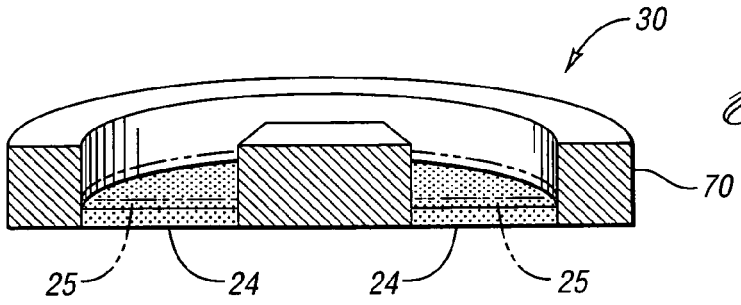
FIG. 5 is a broken perspective view of a mold for collecting and drying friction particulate for making annular friction wafers according to the present invention.

In one embodiment, a mold fill method as shown in FIG. 2, fills a mold 30 with a predetermined amount of aqueous slurry 22 having a known concentration of friction particulate. As shown in FIG. 5, the bottom wall 24 of the mold cavity 26 is a perforated wall, preferably formed from a metal wire or polymer mesh through which water is removed from the slurry and on which the friction wafer is formed. After collection 25 of the particulates, accumulated fibers, friction fillers, binders and resins, water is removed, preferably by suction and/or compression to aid in drying and/or curing. Additionally, the cavity 26 or mold 30 may have an assembly that may include heating elements, or a heating element may be incorporated in a mating mold that is transferred onto the wafer. Preferably, the collection may be transferred by other methods to a curing station 16 (FIG. 1) to further dry and initiate the cure of the wafer. The wafer is removed from the mold cavity 26 or curing station 16 and may then be transferred to sequential stations or machines that may be associated with the production of the friction assembly including the friction wafer.

Another forming embodiment preferred as most easily adapting the previously known die-dried speaker forming equipment, the bottom forming method is shown in FIG. 3. This embodiment uses one or more wafer molds 62 in a tank 40 of slurry. When a vacuum source 41 creates a vacuum behind the mold screen 28, the components in the slurry are drawn to the mold screen 28 and formed by the mold cavity 26 through the suction of water through the porous screen 28 in the mold, thereby forming a wafer. The mold cavity 26 translates up through the slurry to the surface of the tank as the amount of slurry drawn on the mold screen 28 increases with retention time in the slurry and the amount of vacuum. The amount of material deposited is dependent upon the slurry concentration in the tank, the level of vacuum used to remove the water, and the time of submersion or level of displacement in the slurry.

Upon exiting the slurry, a mating mold 50, which is preferably heated by heater elements diagrammatically shown at 52 and pulling a vacuum by a vacuum source 54, contacts the wafer mold 62 to assist with dry-out by removal of additional water and, if required, to initiate the curing of the resin in the wafer material. The wafer is mechanically removed by a transfer machine 60 (FIG. 1) from the wafer mold 62 and transferred to a heated platen or mold 32 (FIG. 1) for subsequent drying, curing, and/or densification if desired. If the wafer is not bonded to a core, the steel substrate to which the friction material wafer is applied, in the heated platen or mold, the wafer is then transferred to subsequent friction wafer assembly operations by a mechanical extraction system.

A third embodiment, the top forming method shown in FIG. 4, includes the insertion of one or more wafer molds 20 into a slurry tank 40. Again, the suction of the water through the porous screen 24 in each mold draws the slurry components onto several mold walls. Like the bottom forming method, the amount of material deposited is dependent upon the slurry concentration in the tank, the level of vacuum used to remove the water and the time of submersion within the slurry. Upon removal of the wafer molds 20 from the slurry in tank 40, a mating mold 50 contacts the wafer mold 20 to assist with water removal and, if required to initiate the curing of the resin in the wafer material. The wafer is removed from the wafer mold 20 by the vacuum source 42 and transferred to a heated platen or mold for subsequent drying, curing, and/or densification if desired. If the wafer is not bonded to the core in the heated platen or mold, the wafer is then transferred to for subsequent friction assembly operations by a mechanical extraction system.

Prior to a mating mold 50 contacting wafer 25 in the forming mold 20, the forming mold 20 can be inserted into a separate tank of slurry or liquid resin to create a multiple layered wafer (25) composite.

In all embodiments the wafer formed by collecting friction particulates on a perforated forming screen in a mold cavity is dried, and can be at least partially cured by heating at a curing temperature. Of course, heating to a lower range temperature may assist removal of the water and/or removal of the wafer so that curing may be effectively completed in a curing stage. Such heating may be in a mold or at a subsequent station. Such processing may eliminate the need for the production of sheet or pads, and subsequent blanking, and/or grinding of the wafer, or trim handling as is associated with the typical roll producing beater add processes. The final cure of the wafer may occur by manners known to those skilled in the art, including during the bonding or sizing operations that complete a friction assembly.

While embodiments of the invention have been illustrated and described, it is not intended that these embodiments illustrate and describe all possible forms of the invention. Rather, the words used in the specification are words of description rather that limitation, and it is understood that various changes may be made without departing from the spirit and scope of the invention.

The invention preferably provides a method for molding a fibrous friction layer or composite, the method comprising collecting friction paper constituents in an aqueous slurry with friction particulate and beater-add resin, in a mold chamber with at least one perforated mold wall to form a molded wafer on said at least one wall. The method also includes reducing water content of said molded wafer and heating said molded part to dry and at least partially cure the resin in said molded part. The curing step may comprise heating said mold chamber, or accomplished in a separate heated mold, or preferably, transferred to one or more heated platen press which may separate the curing time from the accumulation time when accumulation time is shorter, or to more accurately control curing when the mold is not well adapted to accommodate desired control parameter conditions. A transfer to multiple heated platen presses addresses the problem of prolonged curing durations that may be longer than accumulating step durations. Preferably, the curing step may include bonding said molded part to a core when both are introduced to a curing station. Preferably, the process may include molding grooves into said friction layer when such configurations are desired. Preferably, the curing step is accomplished in a separate heated mold when accumulating time is substantially different from curing time. Preferably, the curing step includes transfer to a platen press, particularly when the curing step may include bonding said molded part to a core.

The heating step may comprise a first heating step raising the temperature of a friction resin to a flow threshold for coating said friction particulate. The heating may raise the temperature of the friction resin to a second threshold temperature for curing the resin coating on particulates. The invention may include collecting friction paper constituents by pouring a predetermined amount of aqueous slurry into said mold cavity and removing water through at least one perforated mold wall. The invention may include collecting by displacing said mold chamber within an aqueous slurry. The invention may include collecting by displacing said slurry relative to said perforated mold wall displacing slurry may be induced by creating a pressure differential across said perforated wall. The pressure differential may be varied, and may not be uniform across said perforated mold wall, resulting in a wafer with a non-uniform density or gradient density. The collecting may also include evacuating water past said perforated mold wall. The friction particulates may include at least one of; fibers, friction modifiers, fillers, and binders.

A molded friction wafer for adherence to a clutch plate core, comprising includes a die-dried, collection of aqueous slurry particulates including fibers, at least one friction resin, and friction fillers conforming with cavity defined by mold walls including at least one perforated wall. The friction resin from said aqueous slurry is cured by heating. The wafer may be engaged at least partially flat against said core. The curing may bond the wafer to said core.

The invention also provides a computer readable storage medium having data stored therein representing instructions executable by a computer to control a production process for die-dried friction wafers. The computer readable storage medium comprises instructions for molding a fiber friction wafer by passing aqueous slurry with friction particulate in a direction through a mold chamber including at least one perforated mold wall collecting friction particulate to form a molded wafer on said at least one wall. The instructions for reducing water content of said molded part and instructions for curing said molded part may also be included.

The instructions for said curing step may include instructions for bonding said molded wafer to a core. The curing step may comprise heating said mold chamber. The instructions may include instructions for pouring aqueous slurry into said mold cavity. The instructions may also include instructions for displacing said mold chamber within an aqueous slurry of predetermined concentration of friction particulate ingredients. The instructions may also include instructions for creating a pressure differential across said perforated mold wall to collect particulates of slurry against said wall.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for molding a fiber friction wafer comprising:

passing aqueous slurry comprising paper particulate, friction fillers, and resin in a direction through a mold chamber including at least one perforated mold wall to form a net shape, molded part on said at least one perforated mold wall;

reducing water content of said net shape, molded part; and curing said net shape, molded part.

2. The invention as described in claim 1 and further comprising processing said molded part during at least one of said reducing and curing steps.

3. The invention as described in claim 1 wherein said curing step includes bonding said molded part to a core.

4. The invention as described in claim 1 wherein said curing step comprises heating said mold chamber.

5. The invention as described in claim 1 wherein said passing includes pouring a predetermined amount of aqueous slurry into said mold cavity.

6. The invention as described in claim 1 wherein said passing comprises displacing said mold chamber within an aqueous slurry.

7. The invention as described in claim 1 wherein said passing comprises displacing said slurry relative to said perforated mold wall by applying fluid pressure to said wall.

8. The invention as described in claim 6 wherein said passing comprises pulling a vacuum to deposit slurry constituents onto said perforated mold wall.

9. The invention as described in claim 1 wherein said passing comprises evacuating wafer past said perforated mold wall, leaving slurry constituents attached to mold wall.

10. A method for molding at least one fibrous friction wafer, the method comprising:

collecting friction paper constituents in an aqueous slurry with friction particulate and beater-add resin in a mold chamber on at least one perforated, net shape mold wall to form a molded wafer on said at least one wall;

reducing water content of said molded wafer, and heating said molded wafer to at least partially cure the resin in said molded wafer.

11. The invention as described in claim 10 wherein said collecting slurry comprises sequentially accumulating at least two layers.

12. The invention as described in claim 10 wherein said method further comprises introducing into a solution of liquid resin to at least one layer of molded wafer to increase resin content of the wafer.

13. The invention as described in claim 10 wherein said curing step comprises heating said mold chamber.

14. The invention as described in claim 10 wherein said heating comprises transferring said molded part to a separate heated mold.

15. The invention as described in claim 10 wherein said heating comprises transferring said molded wafer to at least one heated press platen.

* * * * *